US010463910B1

(12) United States Patent
Nakhimovsky

(10) Patent No.: US 10,463,910 B1
(45) Date of Patent: Nov. 5, 2019

(54) PORTABLE STRETCHING DEVICE AND METHOD FOR USE THEREOF

(71) Applicant: Naum Nakhimovsky, Falls Church, VA (US)

(72) Inventor: Naum Nakhimovsky, Falls Church, VA (US)

( * ) Notice: Subject to any disclaimer, the term of this patent is extended or adjusted under 35 U.S.C. 154(b) by 310 days.

(21) Appl. No.: 15/530,835

(22) Filed: Mar. 8, 2017

(51) Int. Cl.
*A63B 23/00* (2006.01)
*A63B 21/00* (2006.01)

(52) U.S. Cl.
CPC ..... *A63B 23/00* (2013.01); *A63B 21/4035* (2015.10); *A63B 2023/006* (2013.01)

(58) Field of Classification Search
CPC ..... A63B 23/0238; A63B 2023/006; A63B 21/0047
See application file for complete search history.

(56) References Cited

U.S. PATENT DOCUMENTS 3,672,361 A * 6/1972 Fourneron ..... A63B 21/0023 606/241
4,517,966 A * 5/1985 von Othegraven .. A61H 1/0218 482/122
5,820,520 A * 10/1998 Sieber ..... A63B 23/0227 482/34
6,129,650 A * 10/2000 Wedge, Jr. ..... A63B 71/0009 482/139
6,203,473 B1 * 3/2001 Atwood ..... A63B 21/00047 482/142
6,447,434 B1 * 9/2002 Waters ..... A63B 21/28 482/140
6,485,400 B1 * 11/2002 Serlachius ..... A63B 23/0211 482/142
7,267,640 B2 * 9/2007 Patton ..... A63B 21/0004 482/128
7,306,547 B2 * 12/2007 Stearns ..... A63B 21/00072 482/91
7,569,003 B1 * 8/2009 Huffman ..... A63B 21/00043 482/111
7,766,804 B2 * 8/2010 Placencia ..... A63B 23/0211 482/121
8,092,354 B2 * 1/2012 Oller, Jr. ..... A63B 21/00047 482/131
8,313,420 B2 * 11/2012 Casha ..... A61H 1/0237 482/131

(Continued)

FOREIGN PATENT DOCUMENTS

FR 2840535 A1 * 12/2003 ..... A63B 23/00
FR 3019734 A1 * 10/2015 ..... A61H 1/0229

*Primary Examiner* — Joshua T Kennedy

(57) ABSTRACT

A portable stretcher consisting of an ergonomically configured main shaft having a plurality of perforations (i.e., round shape openings) at one end configured to receive a round handles stick is provided. The stretcher shaft has an angled top part and a curvature-shaped lower part configured for most effective stretching. Positioning of the handle stick on the stretcher shaft combined with a body forward lean angle defines the range of a spinal stretch. By moving the handles stick up or down along the stretcher shaft, a user can change the stretching range while holding onto the handles stick. For the best stretching results, a user can start at the first position and progressively move the handles stick through all other positions to the top end of the stretcher shaft while continuously leaning forward.

9 Claims, 6 Drawing Sheets

(56) References Cited

U.S. PATENT DOCUMENTS

| | | | | |
|---|---|---|---|---|
| 9,205,297 | B2 * | 12/2015 | Kaehler | A63B 21/02 |
| 9,259,604 | B2 * | 2/2016 | Miller, Jr. | A63B 21/068 |
| 2006/0089239 | A1 * | 4/2006 | Davies, III | A61H 1/02 482/91 |
| 2015/0313785 | A1 * | 11/2015 | Shamas | A61H 1/0296 602/36 |
| 2016/0263425 | A1 * | 9/2016 | Carney | A63B 21/0023 |

* cited by examiner

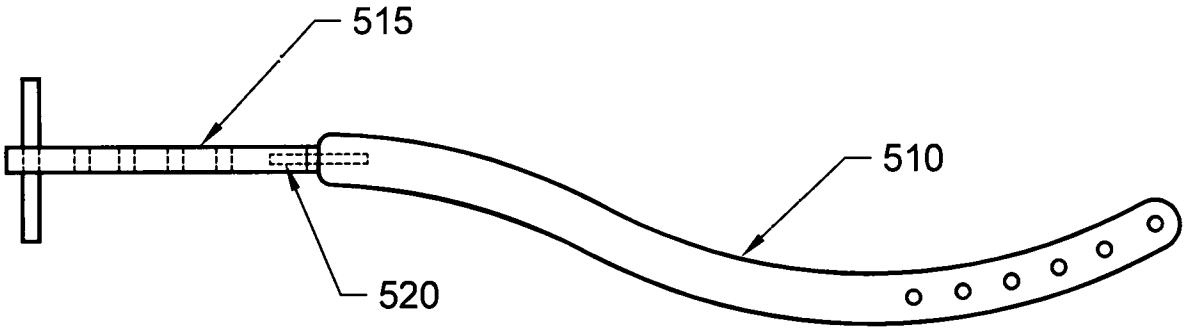
Fig. 5a
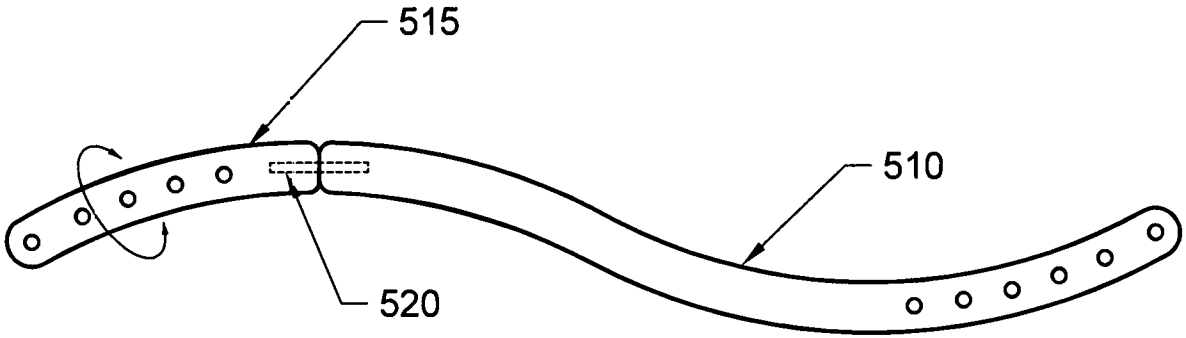
Fig. 5b
Fig. 5

PORTABLE STRETCHING DEVICE AND METHOD FOR USE THEREOF

BACKGROUND OF THE INVENTION

Field of the Invention

This invention relates to a method and device for preventing and healing back and neck pain, and in particular, for a portable stretcher-corrector intended for stretching the spine and correcting positioning of the vertebras and disks in order to prevent and heal vertebras and disk-related problems caused by trauma compression resulting in muscle spasms.

Description of the Related Art

A modern trend for performing work while sitting in front of a computer screen for 8-10 hours a day causes more and more people to experience neck and back pain (e.g., low back pain) more often. Although doctors of chiropractic treat more than just back pain, many patients initially visit chiropractors looking for relief from this pervasive existing condition. In fact, 31 million Americans experience low-back pain at any given time.

A few interesting facts about back pain:

- Low back pain is the single leading cause of disability worldwide, according to the "Global Burden of Disease", 2010;
- Back pain is one of the most common reasons for missed work. In fact, back pain is the second most common reason for visits to the doctor's office, outnumbered only by upper-respiratory infections year around;
- One-half of all working Americans admit to having back pain symptoms each year;
- Experts estimate that as much as 80% of the population will experience a back problem at some time in their lives;
- Most cases of back pain are mechanical or non-organic—i.e., meaning they are not caused by serious conditions, such as inflammatory arthritis, infection, fracture or cancer;

Americans spend at least $50 billion each year on back pain (and that is just for the more easily identified costs).

Causes of back and neck pain can vary. The back is a complicated structure of bones, joints, ligaments and muscles. A person can sprain ligaments, strain muscles, rupture disks, and inflamed joints, all of which can lead to back/neck pain. While sports injuries or accidents can cause back pain, sometimes the simplest of movements such as, for example, picking up a pencil from the floor can have painful results. In addition, arthritis, poor posture, obesity, and psychological stress can cause or complicate back pain. Back pain can also indirectly result from disease of the internal organs, such as kidney stones, kidney infections, blood clots, or bone density loss.

One of the main treatments for back pain is manipulation. Used primarily by doctors of chiropractic for the past century, spinal manipulation has been largely ignored by most others in the health care community until recently. Now, with today's growing emphasis on treatment and cost effectiveness, spinal manipulation is receiving more widespread attention. The spinal manipulation is a safe and effective spine pain treatment. The spinal manipulation reduces pain (decreasing the need for medication in some cases), rapidly advances physical therapy, and requires very few passive forms of treatment, such as bed rest.

In fact, after an extensive study of all available care for low back problems, the federal Agency for Health Care Research and Quality recommended that low back pain sufferers choose the most conservative care first. And it recommended spinal manipulation as the only safe and effective, drugless form of initial professional treatment for acute low back problems in adults. A well respected review of the evidence in the "Annals of Internal Medicine" pointed to chiropractic care as one of the major non-pharmacologic therapies considered effective for acute and chronic low back pain.

More recently, research has shown that there is strong evidence that spinal manipulation for back pain is just as effective as a combination of medical care and exercise, and moderate evidence that it is just as effective as prescription NSAIDS combined with exercise. A patient information article published in the "Journal of the American Medical Association" in 2013 also suggested chiropractic care as an option for people suffering from low back pain—and noted that surgery is usually not needed and should only be tried if other therapies fail.

While spinal and neck manipulation methods employed by doctors of chiropractic are proven to be effective, they can be costly (since most of the Health Insurance Plans do not cover the chiropractic treatments) and the service is not always available. At times it is simply not possible for a patient experiencing severe pain to get to a chiropractor office until the pain subsides. Furthermore, spinal and neck manipulation deal with the consequences of disk compressions and not with their causes. While the chiropractic practices can take care of pain, they often do not produce long lasting results and certainly do not prevent from reoccurrence of disk compressions and related health issues, such as disk degenerations.

Typically, stretching of the spine is performed in the doctor's office on the special reclining boards (or tables). These devices are bulky, expensive and require doctor's expertise. There are in home-used spine stretching apparatuses that are either attached to a door frame or to a horizontal bar. A user buckles into the device using special safety belts and either hangs with the knees pulled up or hangs by the ankles upside down. Obviously, these types of in-home spine stretchers cannot be used by people being in pain, by elderly persons, by overweight person, by children, etc.

Accordingly, an effective and inexpensive in-home stretcher device for spine stretching, healing and prevention of disk compressions is desired.

SUMMARY OF THE INVENTION

Accordingly, the present invention is directed to a portable in home (or office)-used stretcher intended for stretching and correcting the spine in order to prevent, minimize and heal disk degeneration (i.e. reduction in height) caused by trauma or compression that substantially obviates one or more of the disadvantages of the related art.

In one embodiment, a portable stretcher-corrector consisting of an ergonomically configured main shaft having a plurality of perforations (i.e., round shape openings) at one end configured to receive a round handles stick is provided. The stretcher shaft has an angled top part and a curvature-shaped lower part configured for most effective stretching. Positioning of the handle stick on the stretcher shaft defines the range of a spinal stretch. By moving the handles stick up along the stretcher shaft and leaning forward, a user can change the stretching range while holding onto the handles stick.

For the best stretching results, a user can start at the first position and progressively move the handles stick through all other positions to the top end of the stretcher shaft. A lower end of the stretcher shaft is equipped with foam cylinder handles that rest on the front of the user hips (right below his abdomen) while the stretching process takes place. A user can perform the stretching while comfortably sitting on a chair or a stool. The ergonomic shaft design and a progressive nature of the stretching process provide for very effective stretching resulting in relieved inter-vertebras pressure and, advantageously, creating more space between the vertebras. The stretcher shaft can be made of wood, plywood, plastic, light metal, carbon, etc.

In one embodiment, a user can grab onto a stick handle positioned at the furthest possible position. Then the user relaxes and leans forward. The distance n between the spine rotation axis and the device rotation axis is between 15 and 25 cm. Thus, when the user leans forward with relaxed back muscles, a stretching occurs because of a distance created because of the difference in positions of the spine rotation axis and the stretcher rotation axis. The user can lean forward until his chest rests on the upper part of the stretcher.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

In the drawings:

FIGS. 5A-5B illustrates a stretcher shaft consisting of two parts rotationally connected with each other for stretching the chest spinal area, in accordance with the exemplary embodiment;

DETAILED DESCRIPTION OF THE PREFERRED EMBODIMENTS

Figure 1:
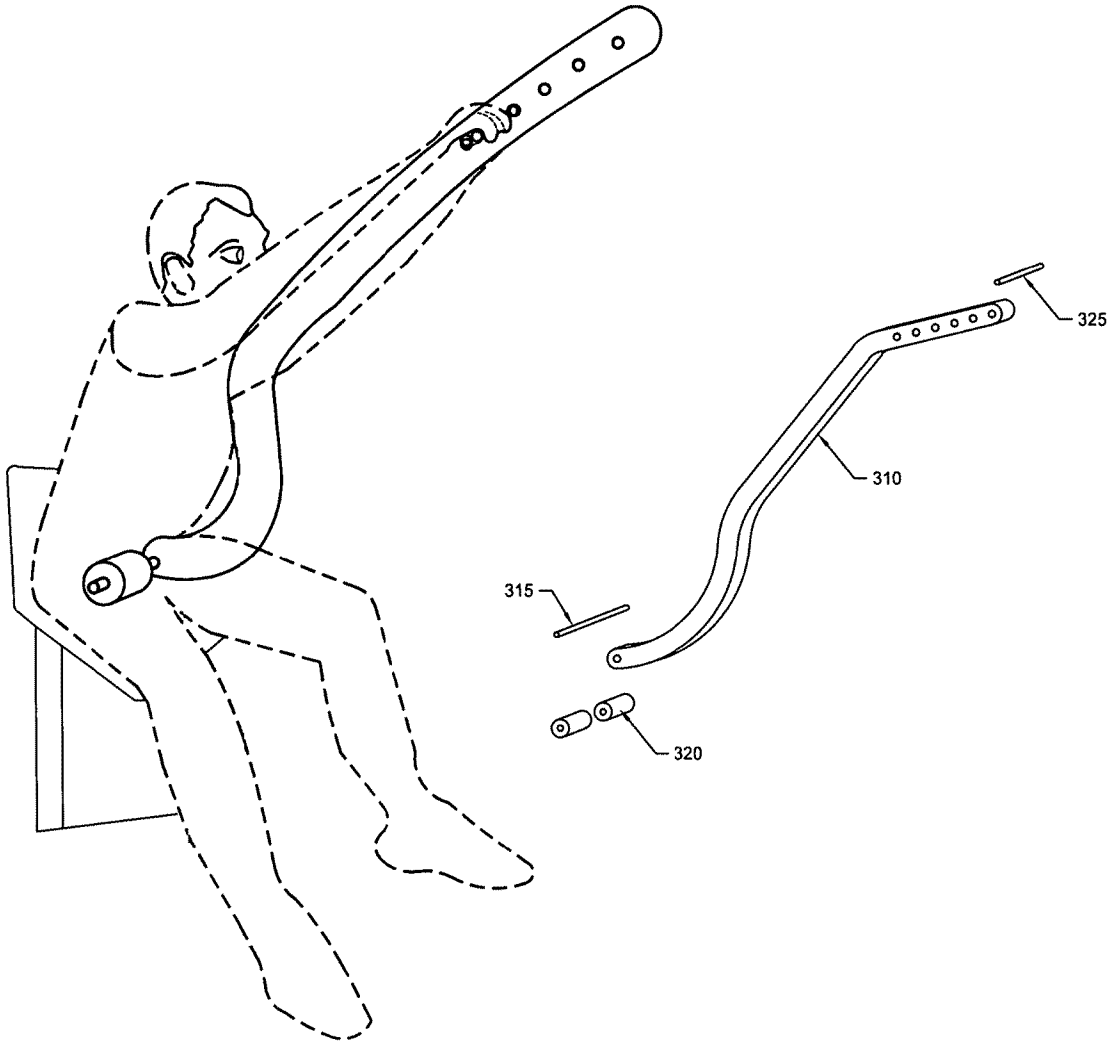
FIG. 1 illustrates how stretching is implemented using a stretcher assembly, in accordance with the exemplary embodiment.

Reference will now be made in detail to the preferred embodiments of the present invention, examples of which are illustrated in the accompanying drawings.

The present invention is directed to a portable device and a method of using it for daily stretching intended to prevent disk (or vertebras) degeneration caused by trauma or compression.

In one aspect of the invention, a stretcher consisting of an ergonomically configured main shaft having a plurality of perforations (i.e., round shape openings) at one end configured to receive a round handles stick is provided. According to the exemplary embodiment, the stretcher shaft has an angled top part and a parabolic curvature-shaped lower part configured for most effective stretching. Positioning of the handle stick on the stretcher shaft and body forward lean angle defines the range of a spinal stretch. By moving the handles stick up or down along the stretcher shaft, while holding onto the handles stick, a user can change the stretching range. Note that the stretcher can be used for a back and a low back area.

In one application, a user can start at the first (lowest or sufficient distance) position and progressively move the handles stick up through all other positions to the top end of the stretcher shaft while continuously leaning forward. According to the exemplary embodiment, a lower end of the stretcher shaft is equipped with foam cylinder handles that rest on the front of the user hips (right below his abdomen) while the stretching process takes place. The foam cylinder handles are intended for reducing uncomfortable pressure in the front area of the hips. A user can perform the stretching while comfortably sitting on a chair or a stool and leaning forward. The ergonomic shaft design and a progressive nature of the stretching process provide for very effective stretching resulting in relieved inter-disk pressure and, advantageously, creating more space between the vertebras. The stretcher shaft can be made of wood, plywood, plastic, light metal, carbon, etc.

In the preferred application, the user can grab onto a stick handle positioned at the furthest possible position. Then the user relaxes and leans forward. The distance n between the spine rotation axis and the device rotation axis can be between 15 and 25 cm. Thus, when the user leans forward with relaxed back muscles, a stretching occurs because of a distance created because of the difference in positions of the spine rotation axis and the stretcher rotation axis. The user can lean forward until his chest rests on the upper part of the stretcher.

According to the exemplary embodiment, the stretcher shaft can be constructed as a monolith part or the shaft can be made as a foldable version. In another embodiment, the stretcher shaft can be implemented as a universal shaft of adjustable length suitable for people of various sizes including children. Such shaft can have a special insert middle section to be used by extra tall persons. According to yet another embodiment, the shaft can be implemented as two parts rotationally connected to each other through a common axis.

The axis pivot point can be located in the upper third of the stretcher shaft, which can be used for upper spine (chest and neck) area correction. The axis pivot point can be located in the lower third of the stretcher shaft as well. In this case, the user can twist his upper body in relation to his lower body for more effective stretching and spinal correction of the lower back area.

According to the exemplary embodiment, the stretching device and a progressive stretching approach recommended to be used with the proposed stretching device provides not only for spine stretching, but also can correct positioning of the vertebras. Regular use of the exemplary stretcher can relieve disk pressure and also increase the inter-vertebras space resulting in healthy back and improving overall conditions of a user.

The length of the upper portion and the curvature of the lower end of the stretcher shaft can vary for use by tall adults and by small children. The lower end curvature can be increased for people with large stomach. The angle of the upper end can be changed to increase stretching torque. In one embodiment, the stretcher can be equipped with a digital scale displaying current stretching force in pounds or kilograms. In another embodiment, the stretcher shaft can include a hydraulic mechanism or an air inflated feature for enhancing stretching effect.

According to the exemplary embodiment, the stretching is implemented as shown in FIG. 1. When a user leans forward, his spine has a low rotation axis. The stretcher shaft 310 also has its own lower rotation axis, which goes through a stem 315 of the cylindrical foam support rollers 320 located in the body fold between the stomach and the upper thighs. The distance n between the spine rotation axis and the device rotation axis is between 15 and 25 cm. Thus, when the user leans forward a stretching distance is created because of the distance n. Note that the support rollers 320 can also be made of rubber, plastic or wood. They can also be implemented as stuffed leather cushions.

This arrangement allows for gradual stretching of the spine in upward and forward directions when the user places the foam supporting rollers 320 into the body fold between the stomach and the upper thighs and grabs onto the handles stick, relaxes and leans forward slowly. Then, the handles stick 325 can be moved to the next position if further stretching is desired. The best stretching results are observed when the stretcher shaft is lowered to approximately 45 degrees from the vertical axis.

Figure 2:
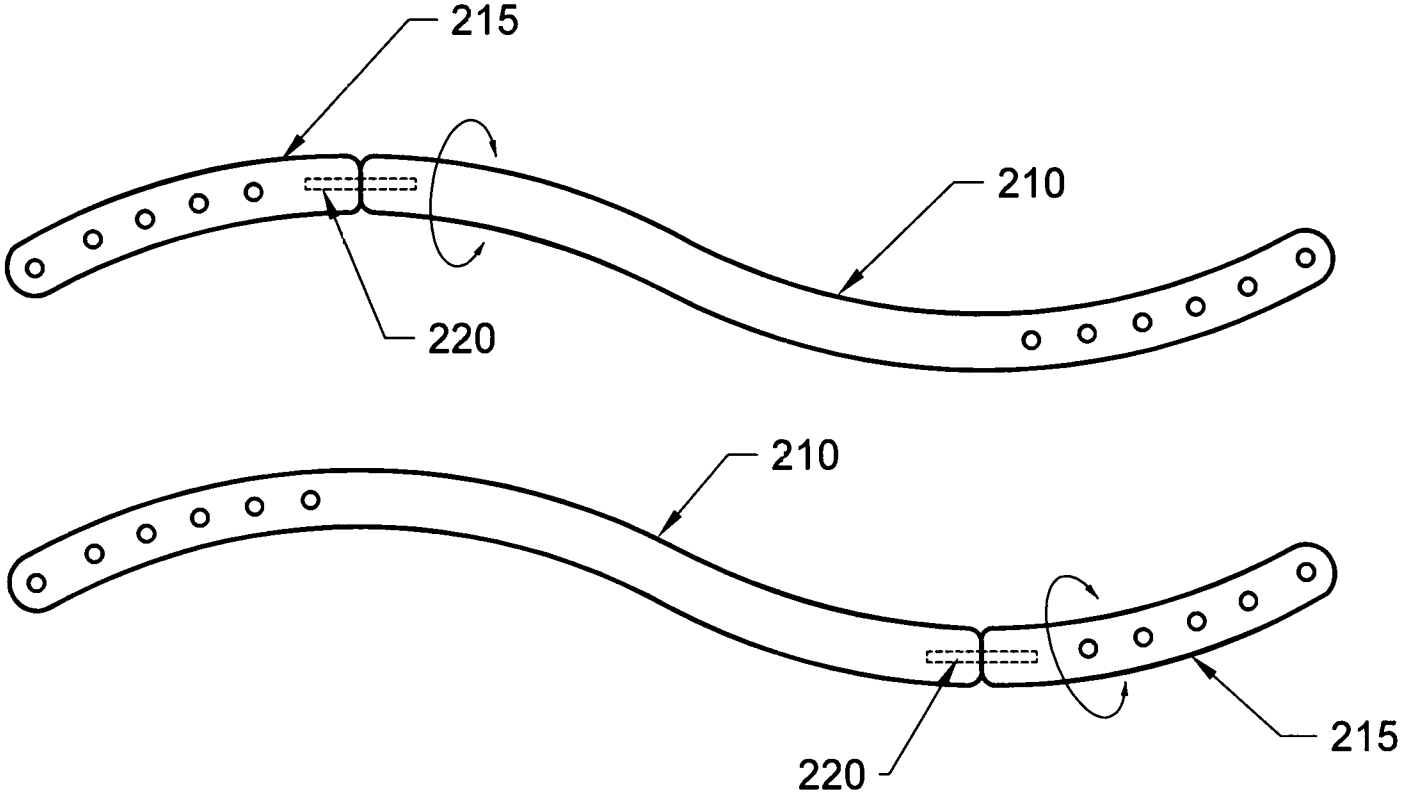
FIG. 2 illustrates a stretcher shaft consisting of two parts rotationally connected with each other, in accordance with the exemplary embodiment.

FIG. 2 illustrates a stretcher shaft consisting of two parts rotationally connected with each other, in accordance with the exemplary embodiment. The stretcher shaft is assembled from two separate parts 210 and 215 rotationally connected by a pin 220. This embodiment is universal as both parts 210 and 215 have multiple perforations for positioning the handles stick 325 (see FIG. 1). This way the user can use the stretcher for either correcting the upper area of the spine or the lower back depending on which part of the shaft is used for placing the handles stick and the foam supporting rollers 320 (see FIG. 1).

Figure 3:
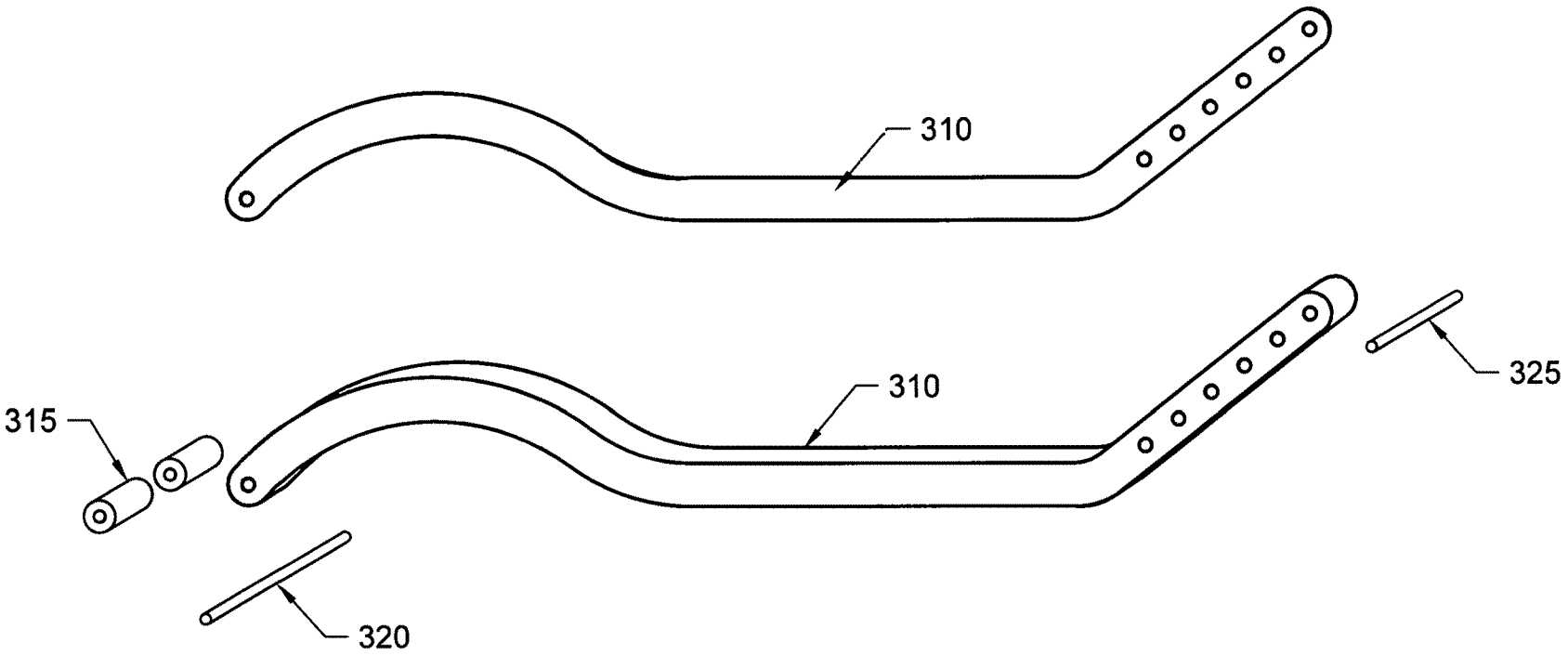
FIG. 3 illustrates a basic stretcher assembly, in accordance with the exemplary embodiment.

FIG. 3 illustrates a basic stretcher assembly, in accordance with the exemplary embodiment. The stretcher shaft 310 has an ergonomic design configured for creating appropriate stretching torque. A lower end of the stretcher shaft has an opening for inserting a stem 320 of the cylindrical foam support rollers 315 that are placed in the body fold between the stomach and the upper thighs. The upper end of the stretcher shaft has a plurality of perforations (holes) for inserting a handles stick 325 for providing various stretching positions.

Figure 4:
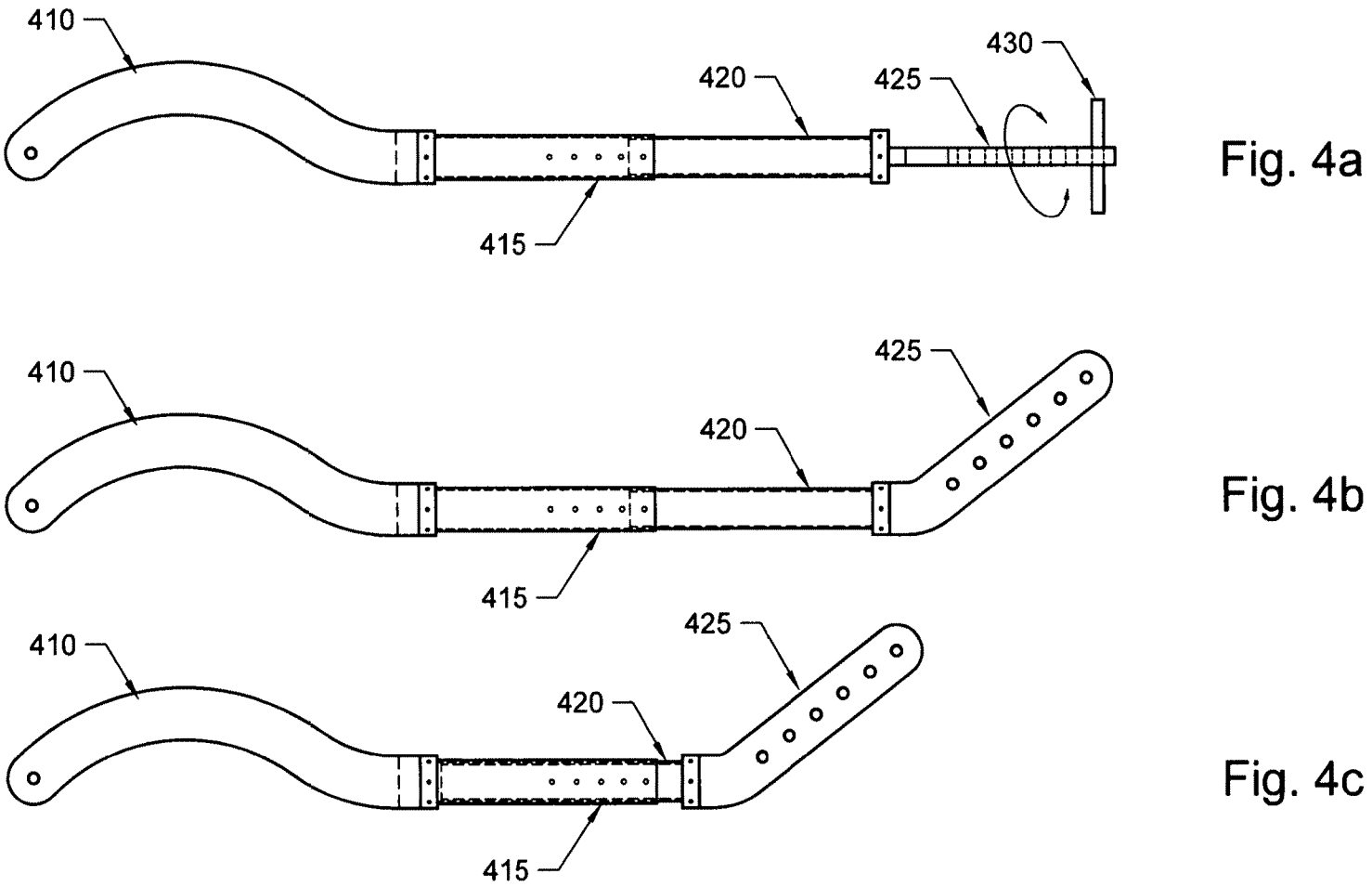
FIGS. 4A-4C illustrate different views of a universal retractable stretcher shaft, in accordance with the exemplary embodiment.

FIGS. 4A-4C illustrate different views of a universal retractable stretcher shaft, in accordance with the exemplary embodiment. In FIG. 4B, illustrates a stretcher shaft in an extracted position. A lower portion of the shaft (i.e., a user side end) 410 has a part 415 configured to receive a slider part 420 of the upper shaft portion (i.e., handles stick end) 425. The part 415 and the slider part 420 can be implemented as a rectangular profile male-female joint or a pipe profile joint. The receiving part 415 has a plurality of holes configured to fit in a positioning pin located on the slider 420. The pin is spring driven and once the pin is fixed in one of the holes of the receiving part 415, it holds the stretcher shaft in the extended/retracted position of the desired length appropriate for the user's size.

In FIG. 4B, the stretcher shaft is shown in a fully extended position, and in FIG. 4C the stretcher shaft is shown in a retracted position. FIG. 4A illustrates an embodiment where the upper shaft portion (i.e., handles stick end) 425 is rotationally attached to the slider 420. Position of the handles stick 430 illustrates an example, where the upper shaft portion 425 is rotated to 90 degrees for upper spine correction.

FIGS. 5A-5B illustrates a stretcher shaft consisting of two parts rotationally connected with each other for stretching the chest and the lower back spinal area, in accordance with the exemplary embodiment. FIG. 5B illustrates an initial position of the upper portion 515 rotationally connected via a rode 520 to the lower end of the stretcher shaft 515. FIG. 5A illustrates an example, where the upper portion 515 with the handles stick is rotated to 90 degrees for more effective upper spine correction. Note that the handling stick can be placed inside one of the holes of the portion of the stretching shaft 510 (instead of portion 520) so that the stretcher is used for correction of lower back spinal area. Thus, the same rotationally connected portions of the stretcher shaft can be, advantageously, used universally by exchanging the positions of the supporting rollers and the handles stick depending on the area of the spine to be corrected.

Figure 6:
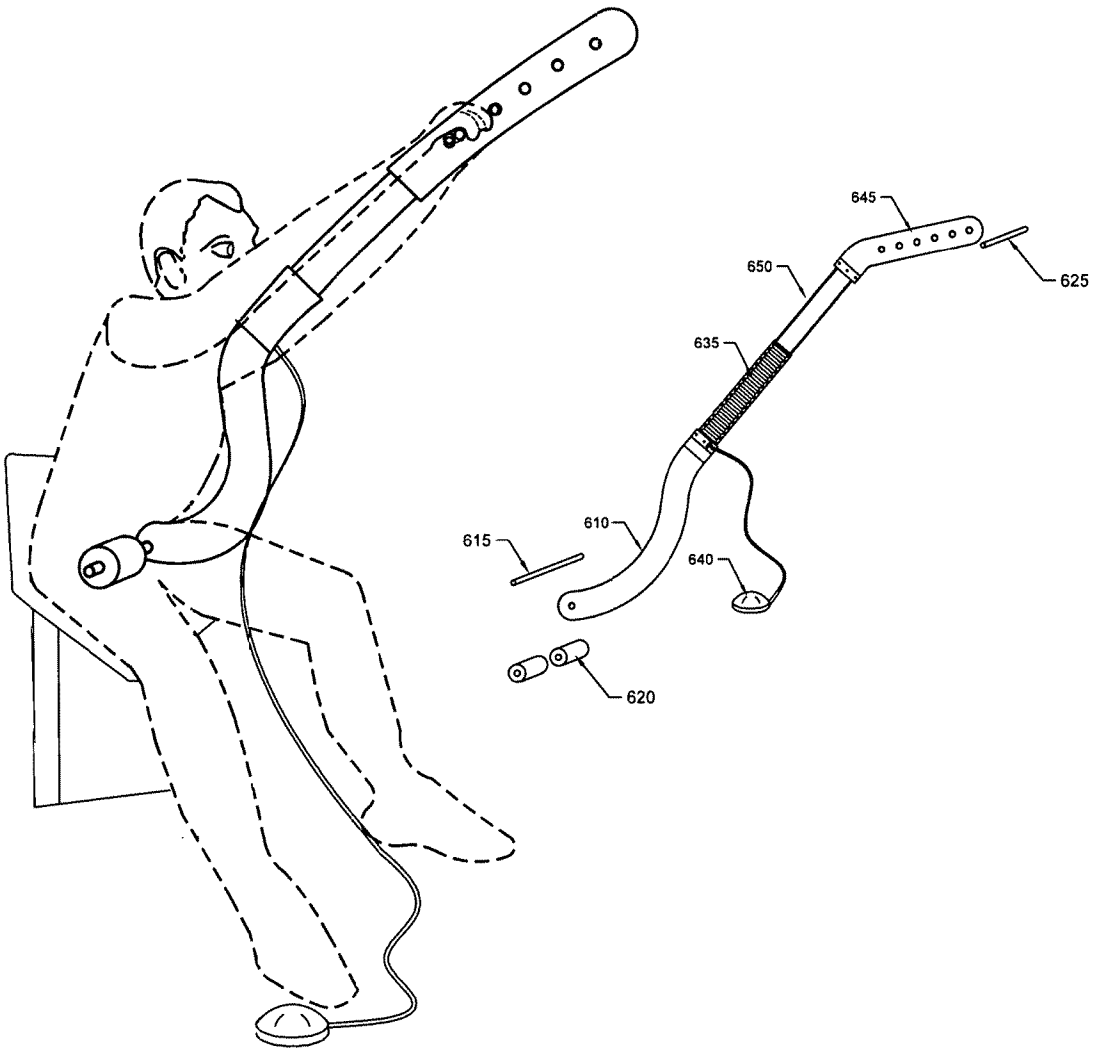
FIG. 6 illustrates and exemplary stretcher implementation with a hydraulic pump feature.

FIG. 6 illustrates and exemplary stretcher implementation with a hydraulic pump feature. When a user leans forward, his spine has a low rotation axis. The stretcher shaft 610 also has its own lower rotation axis, which goes through a stem 615 of the cylindrical foam support rollers 620 located in the body fold between the stomach and the upper thighs. The distance n between the spine rotation axis and the device rotation axis is between 15 and 25 cm. Thus, when the user leans forward, a stretching distance is created because of the distance n.

This arrangement allows for gradual stretching of the spine in upward and forward directions when the user places the foam supporting rollers 620 into the body fold between the stomach and the upper thighs and grabs onto the handles stick 625 positioned in one of the holes 645. Then, instead of moving the handles stick 625 to the next position for further stretching, the user can step on a pump cushion 640 attached to an inflatable tube 635. Once the user pumps on the cushion 640, the inflatable tube 635 inflates and moves the slider part 650 out from the bottom end of the stretcher 610, thereby gradually increasing the stretching distance. This way the user can, advantageously, perform even more gradual and progressive stretching as compared to just moving the handles 625 from one opening 645 to another.

Having thus described a preferred embodiment, it should be apparent to those skilled in the art that certain advantages of the described method and system have been achieved.

It should also be appreciated that various modifications, adaptations, and alternative embodiments thereof may be made within the scope and spirit of the present invention. The invention is further defined by the following claims.

What is claimed is:

1. A portable stretcher device for spine stretching and correction comprising:

an ergonomically configured stretcher shaft with a plurality of holes on an upper end of the stretcher shaft and one hole on a lower end of the stretcher shaft, the stretcher shaft comprising retractable portions connected by a slider;

a handle stick positioned in one of the plurality of the holes on the upper end of the stretcher shaft; and a rod with at least two supporting rollers placed on the rod to be positioned in the one hole on the lower end of the stretcher shaft, wherein the slider is attached to an inflatable tube connected to a foot pump cushion configured to inflate the inflatable tube to move the slider and thereby increase a stretching distance upon being inflated.

2. The stretcher device of claim 1, wherein the end of the stretcher shaft where the supporting rollers are attached has a curvature shape configured to accommodate user's stomach.

3. The stretcher device of claim 1, wherein the end of the stretcher shaft, where the handles stick is inserted, is positioned at an angle to a straight middle portion of the stretcher shaft.

4. The stretcher device of claim 1, wherein the retractable portions of the stretcher shaft are rotationally connected by a rod for rotation while stretching for enhanced spinal correction.

5. The stretcher of claim 4, wherein the slider portion of the stretcher shaft is rotationally connected to a portion having a plurality of holes for accommodating the handle stick.

6. The stretcher of claim 4, wherein the receiver part of the stretcher shaft is rotationally connected to a portion of the stretcher shaft having the rod with the support rollers attached at its end.

7. The stretcher of the claim 1, wherein the stretcher shaft is made of any of:

wood;
plywood;
plastic;
light metal; and
carbon.

8. The stretcher of claim 1, wherein the supporting rollers are made of any of:

rubber;
foam;
stuffed leather; and
plastic.

9. A portable stretcher device comprising:

an ergonomically configured stretcher shaft comprising three sections: a straight middle section, an angled upper section positioned at obtuse angle to a top of the straight middle section and having a parabolic shape extending from a first end attached to a bottom end of the straight middle section to a free bottom end, wherein:

the angled upper section has a plurality of holes for placing a handle stick at different positions; and the parabolic-shaped lower section has a pair of supporting rollers mounted at the bottom end of the parabolic-shaped lower section, wherein:

the pair of the supporting rollers is configured to be placed into a body fold between a user's stomach and user's upper thighs; and the handle stick is configured to be grabbed by the user upon being placed into any of the plurality of the holes on the angled upper section of the stretcher shaft for accommodating user ergonomic parameters, wherein a stretching effect is achieved by a forward lean of a user's upper body.

* * * * *